US009365268B1

(12) United States Patent
Paccoud et al.

(10) Patent No.: US 9,365,268 B1
(45) Date of Patent: Jun. 14, 2016

(54) FENDER FOR A WATERCRAFT

(71) Applicant: BOMBARDIER RECREATIONAL PRODUCTS INC., Valcourt (CA)

(72) Inventors: Colin Paccoud, Sherbrooke (CA); Eric Fournier, Orford (CA); Richard Simard, St-Charles de Drummond (CA)

(73) Assignee: BOMBARDIER RECREATIONAL PRODUCTS INC., Valcourt (CA)

( * ) Notice: Subject to any disclaimer, the term of this patent is extended or adjusted under 35 U.S.C. 154(b) by 0 days.

(21) Appl. No.: 13/941,086

(22) Filed: Jul. 12, 2013

Related U.S. Application Data

(60) Provisional application No. 61/672,025, filed on Jul. 16, 2012.

(51) Int. Cl.
*B63B 59/02* (2006.01)

(52) U.S. Cl.
CPC ..... *B63B 59/02* (2013.01)

(58) Field of Classification Search
CPC ..... B63B 59/00; B63B 59/02; B63B 59/04; B63B 59/45
USPC ..... 114/219
See application file for complete search history.

(56) References Cited

U.S. PATENT DOCUMENTS

| | | | |
|---|---|---|---|
| 4,893,576 | A | 1/1990 | Day et al. |
| 4,895,094 | A | 1/1990 | Carlstedt |
| D306,245 | S | 2/1990 | Akhtarekhavari |
| 4,909,172 | A | 3/1990 | Hamby |
| 4,915,662 | A | 4/1990 | Kent |
| 4,946,727 | A | 8/1990 | Kessler |
| 4,957,055 | A | 9/1990 | Johnson |
| 4,993,123 | A | 2/1991 | Siwek |
| 4,998,495 | A | 3/1991 | Bos et al. |
| 5,013,272 | A | 5/1991 | Watkins |
| 5,013,596 | A | 5/1991 | Kessler |
| D318,312 | S | 7/1991 | Watkins |
| 5,027,736 | A | 7/1991 | Drews |
| 5,096,753 | A | 3/1992 | McCue et al. |
| 5,152,245 | A | 10/1992 | Olsen |
| 5,220,879 | A | 6/1993 | Johnson |

(Continued)

FOREIGN PATENT DOCUMENTS

| | | |
|---|---|---|
| EP | 429107 B1 | 4/1994 |
| EP | 987176 A2 | 3/2000 |

(Continued)

OTHER PUBLICATIONS

Engish Abstract of FR2785865, Published May 19, 2000; Retrieved from the Internet: http://worldwide.espacenet.com on Aug. 14, 2013.

(Continued)

*Primary Examiner* — Daniel V Venne
(74) *Attorney, Agent, or Firm* — BCF LLP

(57) ABSTRACT

A fender for a watercraft which has an outwardly extending flange and a hole extending at least partially through the flange. The fender comprises a flexible fender body adapted to extend at least partially around the flange, and a pin extending from the fender body. The pin is adapted to be received in the hole for removably mounting the fender to the watercraft. Watercraft having fenders installed thereon and methods of installing fenders on a watercraft are also disclosed.

18 Claims, 14 Drawing Sheets

(56) References Cited

U.S. PATENT DOCUMENTS

| | | | | |
|---|---|---|---|---|
| 5,247,897 | A | 9/1993 | Pepp | |
| 5,265,552 | A | 11/1993 | Taylor | |
| 5,269,248 | A | 12/1993 | Lee | |
| 5,299,521 | A | 4/1994 | Loucks | |
| 5,355,822 | A | 10/1994 | Lemke | |
| 5,730,077 | A | 3/1998 | Nunes et al. | |
| 5,743,204 | A * | 4/1998 | Tweet | 114/219 |
| 5,762,019 | A | 6/1998 | O'Rourke et al. | |
| 5,806,452 | A | 9/1998 | Benoit | |
| 5,832,857 | A | 11/1998 | McPherson | |
| 5,836,134 | A | 11/1998 | Couto et al. | |
| 5,870,965 | A | 2/1999 | Hansen | |
| 5,957,073 | A | 9/1999 | Kerber et al. | |
| 5,967,078 | A | 10/1999 | Eilert | |
| 6,021,729 | A | 2/2000 | DeRuscio | |
| 6,050,211 | A | 4/2000 | Yamaguchi | |
| 6,148,754 | A | 11/2000 | Sims, Jr. | |
| 6,152,060 | A | 11/2000 | Steiner | |
| 6,187,420 | B1 | 2/2001 | Tajima et al. | |
| 6,192,818 | B1 | 2/2001 | Rogers-Smith | |
| 6,289,835 | B1 | 9/2001 | Silberman | |
| 6,332,421 | B1 | 12/2001 | Leonard et al. | |
| 6,357,377 | B1 | 3/2002 | Santelli, Jr. | |
| 6,364,293 | B1 | 4/2002 | Beckett | |
| 6,470,819 | B2 | 10/2002 | Silberman | |
| 6,477,973 | B1 | 11/2002 | Kobas | |
| D466,749 | S | 12/2002 | O'Quinn | |
| D478,545 | S | 8/2003 | Maeda et al. | |
| 6,685,395 | B1 | 2/2004 | Busby | |
| 6,752,098 | B2 | 6/2004 | Skulnick | |
| 6,758,156 | B1 | 7/2004 | Kobas | |
| 6,851,163 | B2 | 2/2005 | Selby | |
| 6,863,011 | B2 | 3/2005 | Kinkead | |
| 6,948,440 | B2 | 9/2005 | Aschenbach | |
| D511,723 | S | 11/2005 | Kobas | |
| 6,983,711 | B1 | 1/2006 | Lemke | |
| 7,025,012 | B1 | 4/2006 | Pecharich | |
| 7,036,447 | B2 * | 5/2006 | Tsumiyama et al. | 114/219 |
| 7,080,606 | B1 | 7/2006 | Harrison | |
| 7,143,714 | B1 | 12/2006 | Schmidt | |
| 7,293,518 | B1 | 11/2007 | Gassew et al. | |
| D557,652 | S | 12/2007 | Gassew | |
| D578,464 | S | 10/2008 | Sheedy et al. | |
| 7,430,978 | B2 | 10/2008 | Rezzonico | |
| 7,448,338 | B2 | 11/2008 | Stewart et al. | |
| 7,509,920 | B2 | 3/2009 | Taylor | |
| 7,624,694 | B2 | 12/2009 | Aschenbach | |
| 2003/0217684 | A1 | 11/2003 | Chaffee | |
| 2010/0031862 | A1 | 2/2010 | Powell et al. | |

FOREIGN PATENT DOCUMENTS

| | | | |
|---|---|---|---|
| EP | 827904 | B1 | 4/2003 |
| EP | 1990269 | A1 | 11/2008 |
| FR | 2785865 | A1 | 5/2000 |
| GB | 2388078 | B | 3/2005 |
| GB | 2435014 | A | 8/2007 |
| JP | 2088388 | A | 3/1990 |
| JP | 2283592 | A | 11/1990 |
| JP | 4331691 | A | 11/1992 |
| JP | 5016877 | A | 1/1993 |
| JP | 539085 | A | 2/1993 |
| JP | 9273134 | A | 10/1997 |
| JP | 11301588 | A | 11/1999 |
| JP | 11348880 | A | 12/1999 |
| JP | 2000043786 | A | 2/2000 |
| JP | 03866343 | B2 | 1/2007 |
| JP | 4395256 | B2 | 1/2010 |
| SU | 1740243 | A1 | 6/1992 |
| WO | 0120082 | A1 | 3/2001 |
| WO | 2004033285 | A1 | 4/2004 |
| WO | 2004076749 | A1 | 9/2004 |

OTHER PUBLICATIONS

English Abstract of JP03866343, Published Jan. 10, 2007; Retrieved from the Internet: http://worldwide.espacenet.com on Aug. 14, 2013.
English Abstract of JP4395256, Published Jan. 6, 2010; Retrieved from the Internet: http://worldwide.espacenet.com on Aug. 14, 2013.
English Abstract of JP11301588, Published Nov. 2, 1999; Retrieved from the Internet: http://worldwide.espacenet.com on Aug. 14, 2013.
English Abstract of JP11348880, Published Dec. 21, 1999; Retrieved from the Internet: http://worldwide.espacenet.com on Aug. 14, 2013.
English Abstract of JP2000043786, Published Feb. 15, 2000; Retrieved from the Internet: http://worldwide.espacenet.com on Aug. 14, 2013.
English Abstract of JP2088388, Published Mar. 28, 1990; Retrieved from the Internet: http://worldwide.espacenet.com on Aug. 14, 2013.
English Abstract of JP2283592, Published Nov. 21, 1990; Retrieved from the Internet: http://worldwide.espacenet.com on Aug. 14, 2013.
English Abstract of JP4331691, Published Nov. 19, 1992; Retrieved from the Internet: http://worldwide.espacenet.com on Aug. 14, 2013.
English Abstract of JP5016877, Published Jan. 26, 1993; Retrieved from the Internet: http://worldwide.espacenet.com on Aug. 14, 2013.
English Abstract of JP539085, Published Feb. 19, 1993; Retrieved from the Internet: http://worldwide.espacenet.com on Aug. 14, 2013.
English Abstract of JP9273134, Published Oct. 21, 1997; Retrieved from the Internet: http://worldwide.espacenet.com on Aug. 14, 2013.

* cited by examiner

FENDER FOR A WATERCRAFT

CROSS-REFERENCE

The present application claims priority to U.S. Provisional Patent Application No. 61/672,025, filed on Jul. 16, 2012, the entirety of which is incorporated herein by reference.

FIELD OF THE INVENTION

The present invention relates generally to watercraft and in particular to fenders for watercraft.

BACKGROUND

Fenders are used on all kinds of watercraft to protect the hull and/or deck from damage caused by collisions, such as collisions with a dock or another boat when the watercraft is at rest. Some fenders are permanently installed on the watercraft. Usually, however, the fenders are only deployed when needed.

A personal watercraft (PWC) is typically provided with two fenders that are kept in the storage compartment of the PWC until needed. Prior to arriving at a dock, the fenders are taken out and installed along the side facing the dock, usually one in the front portion and one at the rear portion of the PWC. When the PWC leaves the dock, the fenders are removed and once again stowed away.

On a boat or larger watercraft, fenders are typically suspended over the side of the hull from a railing or another structure. A rope or strap is commonly used to attach the fender to the structure from which it is suspended.

On the other hand, the options for attaching fenders to smaller watercraft, such as a PWC, are limited because of their compact dimensions and construction. For PWCs in particular, fenders are sometimes tied to a ski eye at the vessel's rear. In the front portion of a PWC, a fender is sometimes retained by closing the hatch down on a strap or rope attached to the fender. U.S. Pat. No. 6,021,729, issued Feb. 8, 2000, describes a fender for a PWC having a flex region that allows it to conform to either the front portion or the rear portion of the hull. The fender described therein is provided with a suction cup and/or a securing line for attachment to the PWC. The fender is hooked under the joint between the hull and the deck and extended over the top of the gunnel (also called gunwale) to the inside of the PWC where it is attached by the suction cup and/or securing line to the inside wall of the gunnel.

Fenders that are not attached securely tend to detach and sometimes fall into the water and float away, thus requiring replacement and leading to inconvenience and expense for the riders. It would therefore be desirable to have fenders that can be easily, reliably and securely attached to a small watercraft, such as a PWC.

Some fenders are shaped to conform to the exterior surface of a particular PWC and are therefore not usable with other PWCs. It would be desirable to have versatile fenders that can be used with a wide range of PWCs.

SUMMARY

It is an object of the present invention to ameliorate at least some of the inconveniences present in the prior art.

In one aspect, the present provides a fender for a watercraft. The watercraft has an outwardly extending flange and a hole extending at least partially through the flange. The fender includes a flexible fender body adapted to extend at least partially around the flange, and a pin extending from the fender body. The pin is adapted to be received in the hole for removably mounting the fender to the watercraft.

In a further aspect, the fender body comprises: an inner surface adapted to face inwardly towards the watercraft when the fender is installed thereon and an outer surface adapted to face outwardly from the watercraft when the fender is installed thereon. The fender includes an inner portion, an outer portion, and a central portion connecting the inner portion to the outer portion. The fender body is generally U-shaped.

In a further aspect, the pin extends from one of the outer portion and the central portion of the fender body.

In yet another aspect, the inner portion has at least one region disposed between adjacent regions, the thickness of the at least one region being less than the thickness of the adjacent regions.

In yet another aspect, the inner surface in the at least one region has a groove extending into the fender body towards the outer surface.

In yet another aspect, the outer surface in the at least one region has an indentation opposite the groove of the inner surface.

In an additional aspect, the central portion is connected to the outer portion along the outer surface.

In another aspect, the central portion is connected to the outer portion by a living hinge.

In a further aspect, the living hinge is defined by a channel. The channel extends between the outer portion and the central portion. The channel extends from the inner surface into the fender body towards the outer surface.

In a further aspect, one of the outer portion and the central portion comprises a gripping surface adapted to engage the watercraft, the gripping surface being proximate the pin.

In an additional aspect, the gripping surface extends from the inner surface towards the outer surface.

In an additional aspect, the pin has a first end held by one of the outer portion and the central portion of the fender body. A second free end is opposite the first end. The outer portion comprises a projection extending inwardly the inner portion. The second free end is between the projection and the first end.

In another aspect, the projection has a surface disposed substantially perpendicular to the pin and facing the second free end of the pin.

In another aspect, the surface of the projection is a first surface, the projection having a second surface disposed at an obtuse angle to the pin, the second surface being adjacent to the first surface.

In another aspect, a surface of the projection on a side of the projection facing the free end of the pin is disposed at an obtuse angle to the pin.

In an additional aspect, the pin has a first end, held by one of the outer portion and the central portion of the fender body, and a second end opposite the first end. The outer portion includes a projection extending inwardly towards the inner portion.

In another aspect, the second end is between the projection and the first end.

In yet another aspect, the projection has a surface disposed substantially perpendicular to the pin and facing toward the first end of the pin.

In a further aspect, the surface of the projection is a first surface, the projection having a second surface disposed at an obtuse angle to the pin, the second surface being adjacent to the first surface.

In an additional aspect, a slot extends into the projection from the surface. At least a portion of the pin is removably received in the slot.

In yet another aspect, the projection has an inner surface disposed substantially parallel to the pin. The slot extends from the inner surface such that the pin is received into the slot from the inner surface.

In yet another aspect, the fender body comprises at least one cavity extending into the fender body.

In an additional aspect, the fender body is formed of molded foam.

In an additional aspect, the pin is overmolded in the fender body.

In another aspect, a watercraft is provided. The watercraft includes a hull, and a deck disposed on the hull and connected thereto. A flange extends outwardly from at least one of the deck and the hull. An upper surface of the flange comprises a hole extending at least partly through the flange. A fender is removably mounted to the watercraft. The fender includes a flexible fender body extending at least partly around the flange, and a pin extends from the fender body. The pin is removably received in the hole.

In another aspect, a method is provided for installing a fender on a watercraft. The watercraft has an outwardly extending flange and a hole extending at least partly through the flange. The fender has a fender body and a pin extending from the fender body. The method includes: placing the fender above the flange, aligning the pin with the hole, moving the fender towards the flange, inserting the pin into the hole, and extending the fender body at least partly around the flange.

In another aspect, after extending the fender body at least partly around the flange, an inwardly extending projection of the fender body is pushed towards the pin and the pin is received in a slot defined in the projection.

In an additional aspect, the method further includes engaging a flange surface with a portion of the fender body disposed opposite to the pin.

In a further aspect, before inserting the pin into the hole, the fender body is pressed against a surface of the watercraft above the flange to flex at least a portion of the fender body.

In yet another aspect, the method further comprises extending a portion of the fender body over an upwardly facing edge, the edge being disposed above the outwardly extending flange.

For purposes of the present application, terms related to spatial orientation when referring to a personal watercraft and components in relation to the personal watercraft, such as "forwardly", "rearwardly", "left", "right", "above" and "below", are as they would be understood by a driver of the personal watercraft, with the personal watercraft in a straight ahead orientation (i.e. not steered left or right), and in an upright position (i.e. not tilted and not trimmed).

Embodiments of the present invention each have at least one of the above-mentioned object and/or aspects, but do not necessarily have all of them. It should be understood that some aspects of the present invention that have resulted from attempting to attain the above-mentioned object may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION

Although the following is described with respect to a personal watercraft, it will be understood that the present invention could also be applied to other kinds of watercraft.

Figure 1A:
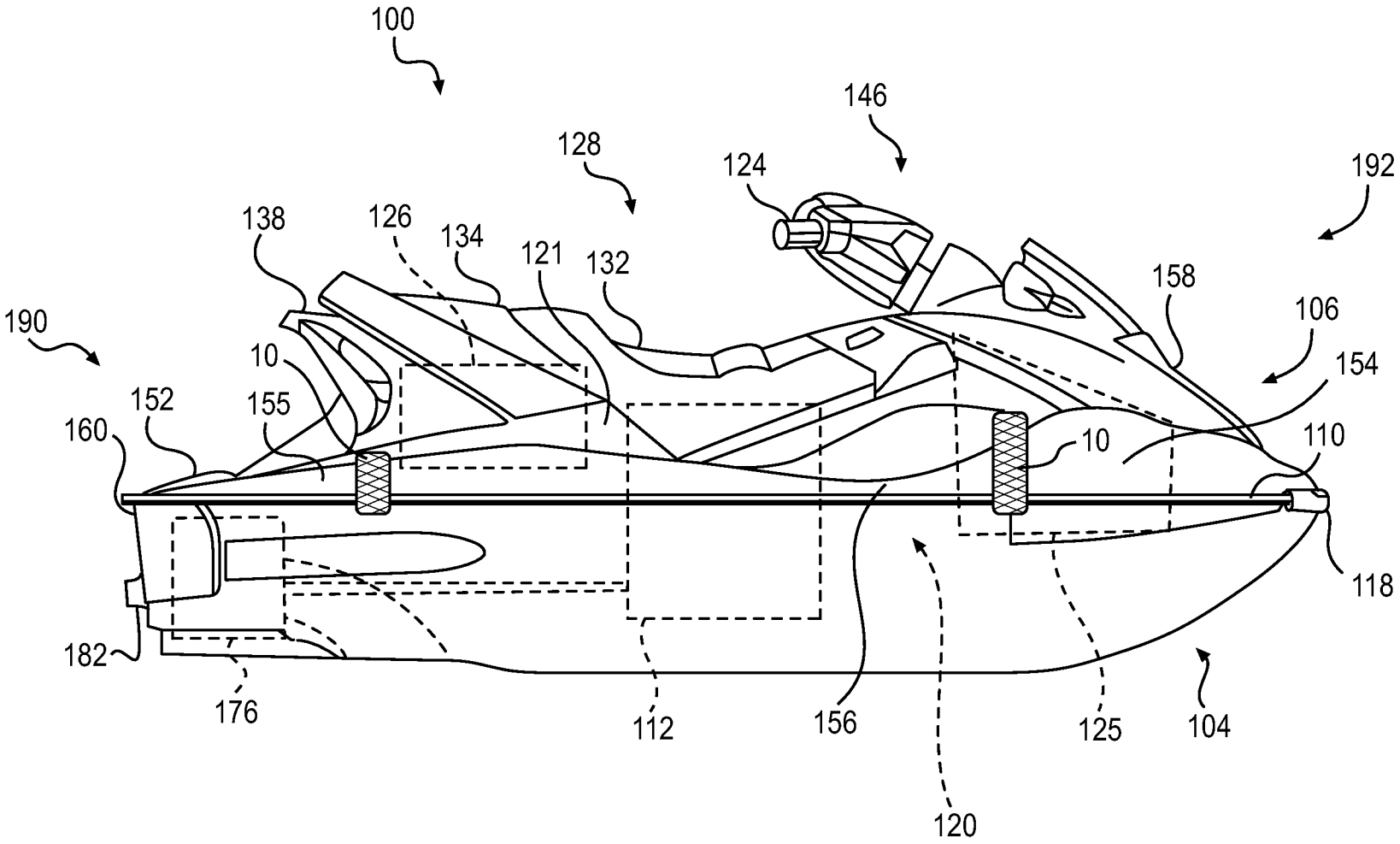
FIG. 1A is a right side elevation view of a personal watercraft (PWC) having two fenders, attached to front and rear right portions thereof, on a right side of the PWC.
Figure 1B:
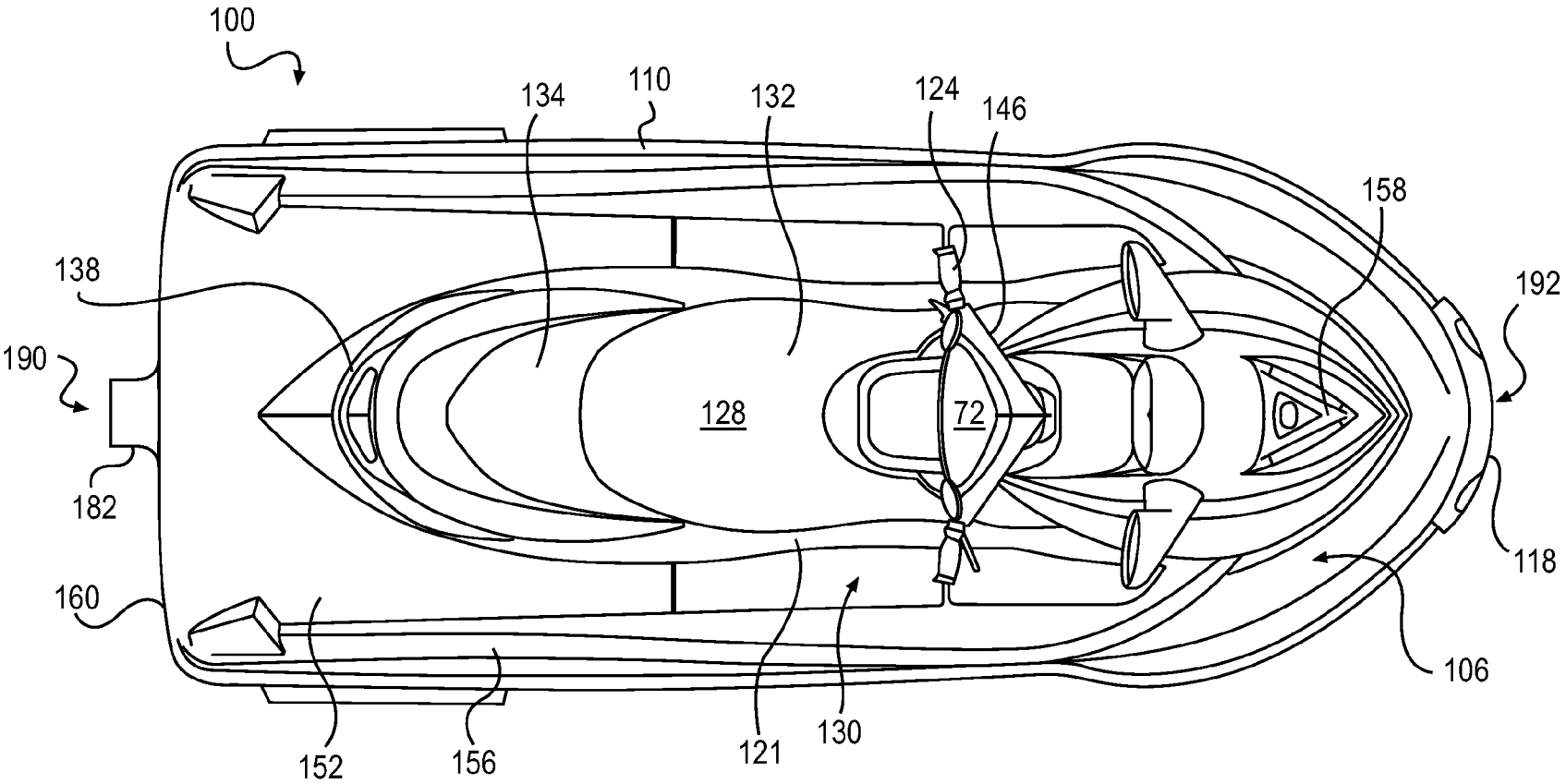
FIG. 1B is a top plan view of the PWC of FIG. 1A shown without the fenders.

Referring to FIGS. 1A and 1B, a personal watercraft (hereinafter called PWC) 100 will be described generally. The PWC 100 has a forward portion 192 and a rearward portion 190. The PWC 100 is made of a hull 104 and a deck 106 disposed on the hull 104. The hull 104 buoyantly supports the PWC 100 in the water. The deck 106 is designed to accommodate a driver and one or more passengers. The deck 106 and the hull 104 are made of fiberglass or other suitable material.

The hull 104 and deck 106 are joined together at a joint line (not shown). Fasteners, such rivets or bolts, or an adhesive may be used to join the hull 104 to the deck 106. A bumper 110 generally covers the joint line or a part thereof, which helps to prevent damage to an outer surface of the PWC 100. The joint line and the bumper 110 extend horizontally around the perimeter of the PWC 100, as seen in FIG. 1B. It is, however, contemplated that a portion of the joint line and bumper 110 could extend at an angle to the horizontal direction. The watercraft 100 also includes a front bumper 118.

The volume created between the hull 104 and the deck 106 is known as the engine compartment 120. The engine compartment 120 accommodates an engine 112 (shown schematically), a jet pump 176 (shown schematically) operatively connected to the engine 112 for propelling the PWC 100, as well as other elements required by or desired for the PWC 100. It is contemplated that other types of propulsion systems, such as propellers, could also be used.

The deck 106 has a pedestal 121 on top of which a straddle seat 128 is centrally positioned. The straddle seat 128 accommodates the driver and a passenger, respectively, in a first central portion 132 and a second raised rearward portion 134. The first portion 132 of the straddle seat 128 covers an engine access opening (not shown), which provides access to the engine 112 (shown schematically in FIG. 1A). The second portion 134 covers a removable storage box 126 (shown schematically in FIG. 1A). A grab handle 138 is provided between the pedestal 121 and the straddle seat 128 rearward of the second portion 134 to provide a handle onto which a passenger may hold on. It is contemplated that the straddle-seat 128 could be sized to accommodate only a driver or more than one passenger in addition to the driver.

A helm assembly 146 is positioned forwardly of the straddle seat 128. The helm assembly 146 includes a steering column (not shown) connected to a handlebar 124. The steering column is connected to a rotatable nozzle 182 rearwardly of the jet pump 176. It is contemplated that the handlebar 124 could be replaced by a steering wheel or other steering device.

The PWC 100 is provided with a hood 158 located in the forward portion 192 of the PWC 100. The hood 158 provides access to a storage compartment 125 (shown schematically in FIG. 1).

A reboarding platform 152 is provided in the rearward 190 of the PWC 100 to allow the rider or a passenger to easily reboard the PWC 100 from the water. A retractable ladder may be affixed to a transom 160 to facilitate boarding the PWC 100 from the water onto the reboarding platform 152.

The deck 106 includes a pair of generally upwardly extending walls, known as gunwales or gunnels 156, including a forward gunnel 154 and a rearward gunnel 155, located on either side of the PWC 100. The gunnels 156 help to discourage the entry of water in the PWC 100, provide lateral support for the driver's feet, and also provide buoyancy when turning the PWC 100. The gunnels 156 extend inwardly at the rear portion of the deck 106 to act as heel rests 144. The upper surface of the gunnel 156 is curved with respect to the horizontal bumper 110. The gunnels 156 are spaced inwardly from the bumper 110 on each side of the PWC 100.

Located on either side of the straddle seat 128, between the pedestal 121 and the gunnels 156, are a pair of footrests 130. The footrests 130 are designed to accommodate the driver's feet in various riding positions.

In FIG. 1A, a pair of fenders 10 are removably installed on the right side of the PWC 100, one in the forward portion 192 and one in the rearward portion 190. The fenders 10 are removably fixed under the bumper 110 along a portion of the hull 104 immediately therebelow, extended around the bumper 110 and upwards over the gunnel 156. It is contemplated that the fenders 10 could be installed on the left side of the PWC 100 and at any location along either side that is most convenient, for example, taking into consideration, the position of the PWC 100 with respect to the dock. The fender 10 will be discussed below in further detail.

Turning now to FIGS. 2 to 5, the fender 10 will be described in its non-flexed state as shown in these figures. The fender 10 comprises a fender body 12 and a retaining pin 20 extending from the fender body 12. The fender body 12 is flexible, resilient and buoyant. The pin 20 is substantially rigid in comparison to the fender body 12. The fender body 12 is formed from a closed-cell foam. The pin 20 is formed from plastic.

Figure 2:
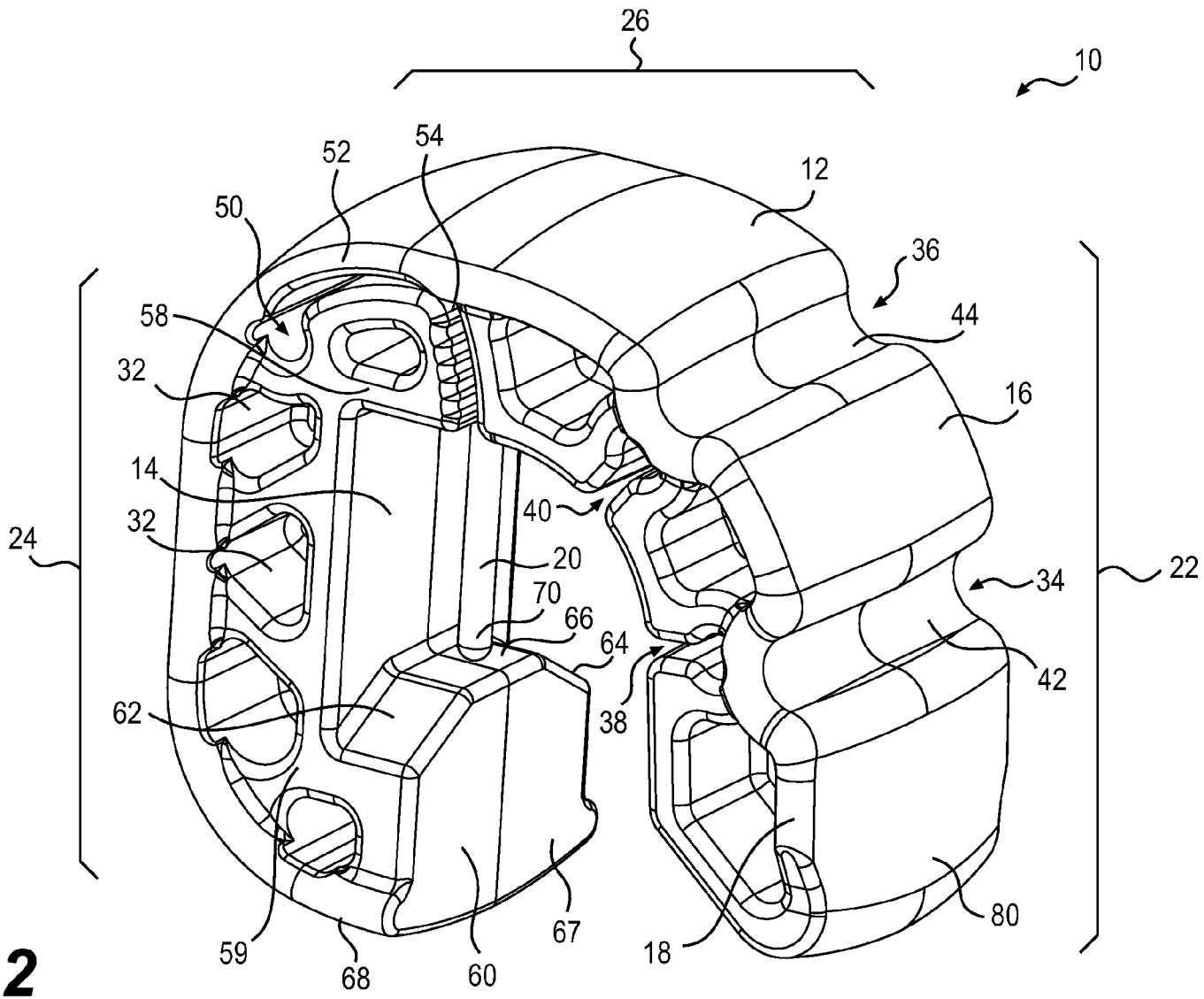
FIG. 2 is a perspective view, taken from a front, left side of one of the fenders of FIG. 1A shown in isolation.
Figure 3:
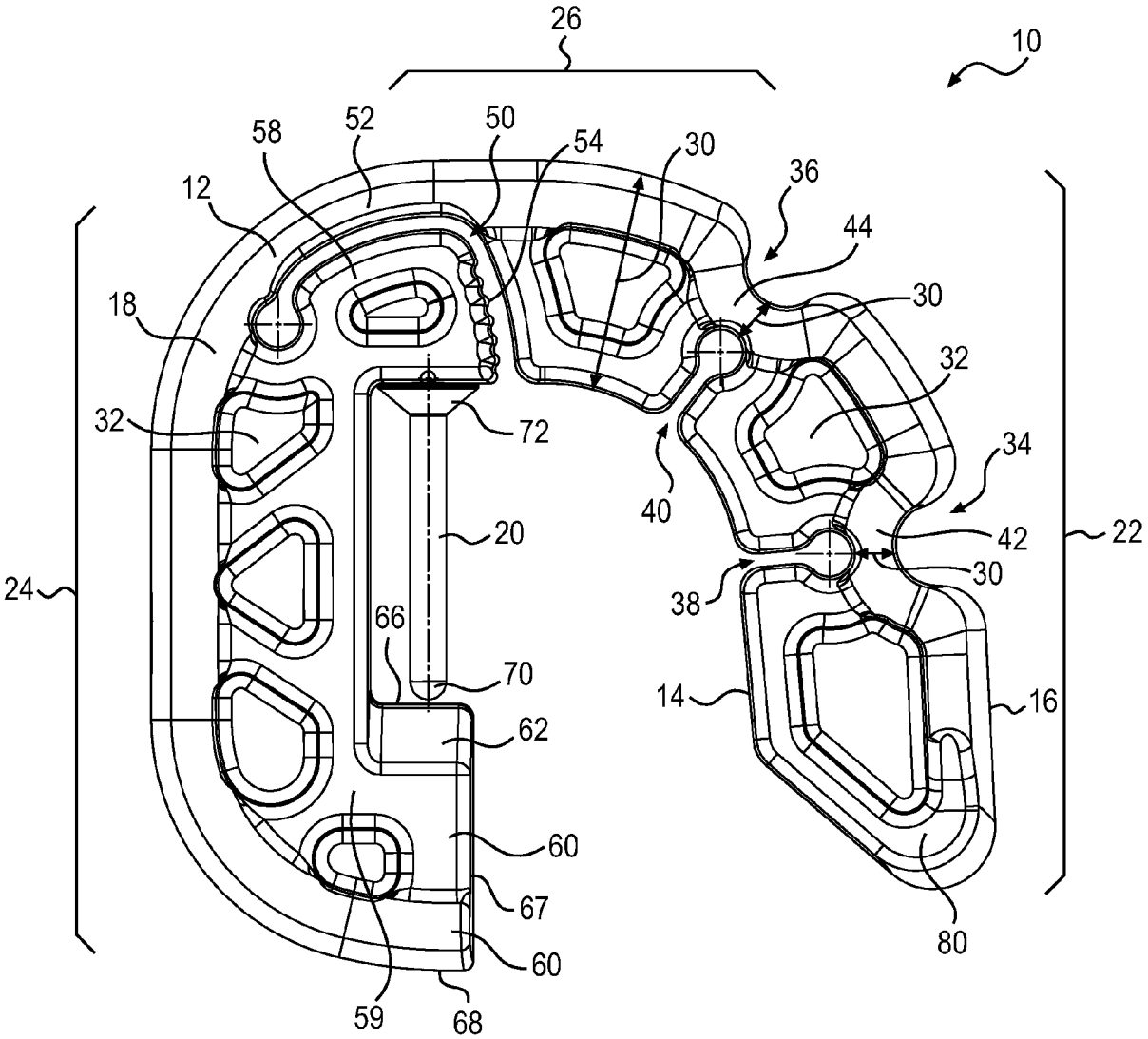
FIG. 3 is a front elevation view of the fender of FIG. 2.

With reference to FIGS. 2 and 3, the fender body 12 is generally U-shaped with an inner surface 14 and an outer surface 16 opposite the inner surface 14. The U-shaped fender body 12 has an inner portion 22, an outer portion 24 and a central portion 26 connecting the inner and outer portions 22 and 24. The pin 20 extends from the outer portion 24. It is contemplated that the pin 20 could extend from the central portion 26.

When the fender 10 is installed on the PWC 100, the inner surface 14 faces the PWC 100 and the pin 20 helps to attach the fender body 12 onto the PWC 100. The U-shaped fender body 12 with the pin 20 is adapted to be attached to the bumper 110 or other outwardly extending flange. The U-shaped fender body 12 is further adapted to optionally extend over an edge, such as that formed by the top of the gunnel 156 of the PWC 100.

As will be described in further detail below, when the fender 10 is installed on the PWC 100, the outer portion 24 extends around the outwardly extending bumper 110. The central 26 and inner 22 portions extend above the bumper 110 and over the gunnel 156 if present. On a PWC which does not have a gunnel extending above the bumper 110 (such as that shown in FIG. 9), the inner portion 22 extends along the inside of the vertical wall extending below the bumper 110, with the central portion 26 extending substantially horizontally on the upper surface of the bumper 110.

The fender 10 has two surfaces 18, 19 that extend between the inner and outer surfaces, 14 and 16. When the fender 10 is installed on the right side of the PWC 100, the surface 18 faces frontwards and the surface 19 faces rearwards. Accordingly, these surfaces will hereinafter be referred to as the front surface 18 and the rear surface 19. It will, however, be understood that the terms "front" and "rear" surfaces are being used for convenience only, and the actual disposition of the surfaces 18, 19 will depend on the installation location of the fender 10. For example, when the fender 10 is installed on the left side of the PWC 100, the front and rear surfaces will be 19 and 18 respectively.

In the illustrated embodiment of the fender 10, the fender body has a generally rectangular cross-section with the inner surface 14, outer surface 16, and surfaces 18, 19 being generally perpendicular to the respective adjacent surfaces. It is, however, also contemplated that the cross-section of the fender body could be other than rectangular, for example, the fender 10 could have a cross-section that is circular, semi-circular, elliptical, trapezoidal, or any other shape.

With reference to FIG. 3, the fender body has a thickness 30 measured between the inner and outer surfaces, 14 and 16. The thickness 30 of the fender body is not uniform as the separation between the inner and outer surfaces, 14 and 16, is not the same throughout the fender body 12.

With reference to FIGS. 2 and 3, cavities 32 are molded into the front and rear surfaces 18, 19 of the fender body 12 to facilitate manipulation of the fender 10 during installation and removal from the PWC 100. The cavities 32 also serve to make the fender body 12 lighter and thus more buoyant.

The outer surface 16 is generally continuous with shallow indentations, 34 and 36, in the inner portion 24. The indentations 34, 36 on the outer surface 16 extend across the fender body 12 between the front surface 18 and the rear surface 19. When viewed from the front of the unflexed fender 10, the outer surface 16 curves downwards towards the inner surface 14 so that the indentations 34, 36 are generally circular in shape.

The inner surface 14 is discontinuous, having grooves, 38 and 40, and channel 50. The grooves 38 and 40 are formed, on the inner surface 14, respectively opposite to the indentations 34 and 36 of the outer surface 16.

The grooves 38 and 40 extend from the inner surface 14 into the fender body 12 towards the outer surface 16. The walls of the grooves 38, 40 extending from the inner surface 14 are substantially perpendicular to the adjacent inner surface. As best seen in FIG. 3, when the fender body 12 is not flexed, the groove walls extend generally parallel to one another in the section adjacent to the inner surface 14, and then curve away from one other to form a generally circular section at the opposite end near the outer surface 16. The grooves 38, 40 extend across the fender body 12 between the front and rear surfaces, 18 and 19.

With reference to FIG. 2, the opposing grooves 38, 40 and indentations 34, 36 of the inner 14 and outer 16 surfaces form regions 42, 44 of reduced thickness in the fender body 12. The thickness 30 of the fender body 12 in the region 42 is defined by the separation between the opposing groove and indentation, 38 and 34. Similarly, the thickness of the fender body 12 in the region 44 is defined by the separation between opposing groove and indentation, 40 and 36. Therefore, the thickness 30 of the fender body is reduced in the regions 42, 44 compared to the thickness 30 in the adjacent regions where the separation between the inner and outer surfaces 14 and 16 is greater.

It is contemplated that the regions 42, 44 of reduced thickness could be formed in other ways. It is contemplated that the indentations 34, 36 could be omitted. It is contemplated that the indentations 34, 36 could be grooves. It is contemplated that the grooves 38, 40 could be indentations. It is contemplated that the shape and dimensions of the grooves and/or indentations could be different, and that there could be more or less than one groove/indentation on each of the inner and outer surfaces 14, 16.

With reference to FIGS. 2 and 3, a long C-shaped channel 50 extends between the outer portion 24 and the central portion 26 of the fender body 12. The channel 50 extends from the inner surface 14 into the fender body 12 towards the outer surface 16 and then parallel to the outer surface 16. When the fender body 12 is not flexed, as best seen in FIG. 3, the walls of the channel 50 are generally parallel to each other, except at the end of the channel 50 inside the fender body 12 where the channel walls form a circular section. The channel 50 defines a living hinge 52 between the outer surface 16 and the channel 50. The living hinge 52 connects the outer portion 24 to the central portion 26 of the fender body 12.

The living hinge 52 enables the inner and central portions, 22 and 26, to pivot with respect to the outer portion 24. The regions 42, 44 of reduced thickness also facilitate flexing of the inner portion 22 of the fender body 12. In the embodiment illustrated, the inner and central portions, 22 and 26, are flexible while the outer portion 24 is more rigid. It is contemplated, however, that a portion of the outer portion 24 could be as flexible as the inner and central portions 22, 26. Flexing of the fender body 12 enables the fender 10 to be used with a wide range of PWCs 100 and with variously shaped flanges and gunnels 156 disposed in different locations on a PWC 100, as will be discussed below.

With reference to FIG. 2, the outer portion 24 is generally C-shaped with opposite end portions 58, 59. The end portion 58 is connected to the central portion 26 and has embedded therein one end of the pin 20. The end portion 58 is separated from the living hinge 52 by the channel 50. The end portion 59 has a projection 60 extending towards the inner portion 22 underneath the pin 20.

Figure 9:
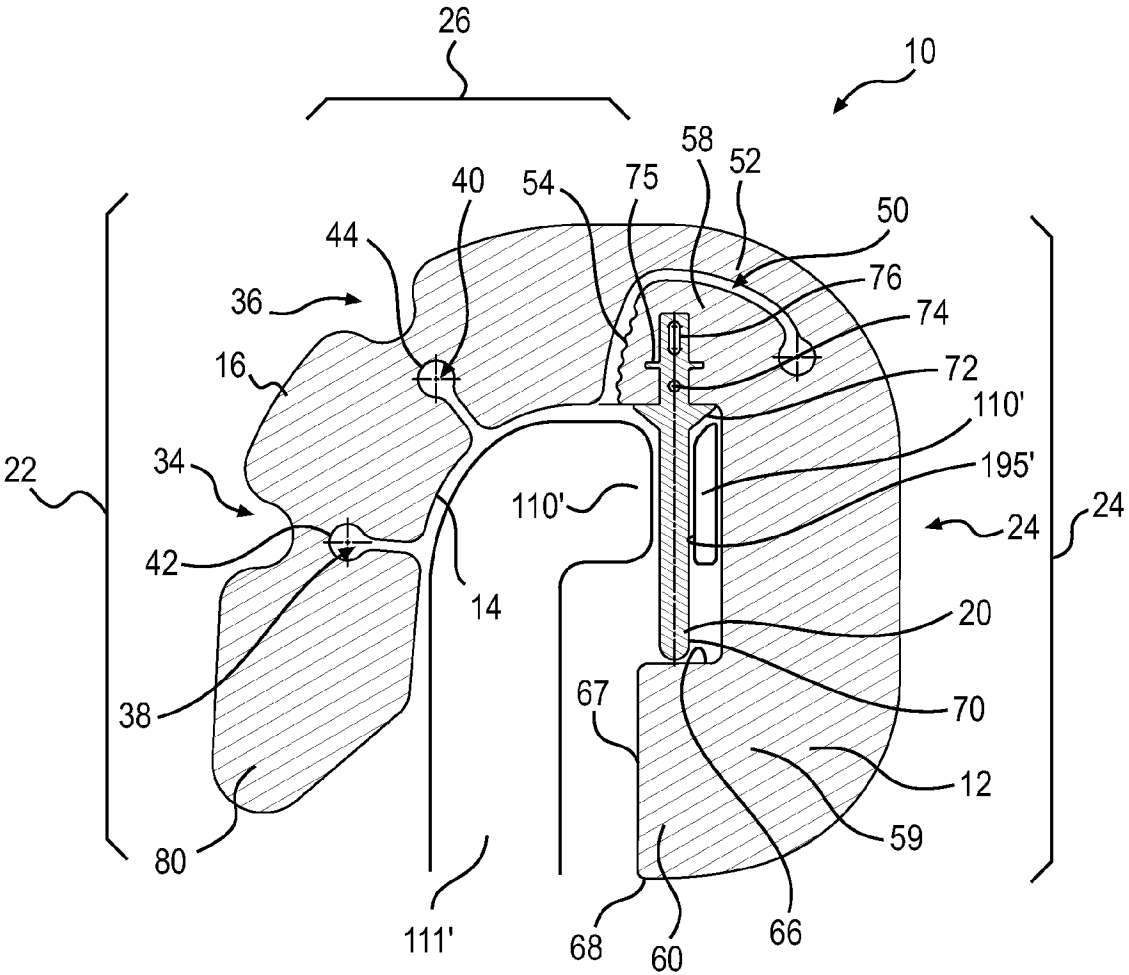
FIG. 9 is a cross-sectional view of the fender of FIG. 2 installed on a flange of extending outwardly from the top of a vertical wall.

The projection 60 has an upper surface facing the pin 20 with a centered region 66 between outward regions 62, 64. The centered region 66 is disposed directly underneath the free end 70 of the pin 20 and perpendicular to the pin 20. The outward regions 62, 64 are disposed at an angle greater than 90 degrees with respect to the pin 20. The centered region 66 is adapted to engage the lower portion of the bumper 110 extending outwardly from the PWC 100 (as best seen in FIG. 9). The laterally outward surfaces 62, 64 are angled away from the centered region 66 and the pin 20 to facilitate installation of the fender 10 along a curved portion of the bumper 110. The projection 60 has an inner surface 67 facing the inner portion 22 of the fender body 12. The projection 60 has a lower surface 68 facing away from the pin 20 and disposed opposite the upper surface formed by regions 66, 62, 64. In the illustrated embodiment, the projection 60 of the outer portion 24 is formed at the end portion 59 of the fender body 12 such that the lower surface 68 forms a portion of the outer surface 16 of the fender body 12. It is however contemplated that the outer portion 24 could also extend below the projection 60. It is also contemplated that the lower surface 68 of the projection 60 could not formed continuously with the outer surface 16 of the fender body 12.

Figure 4:
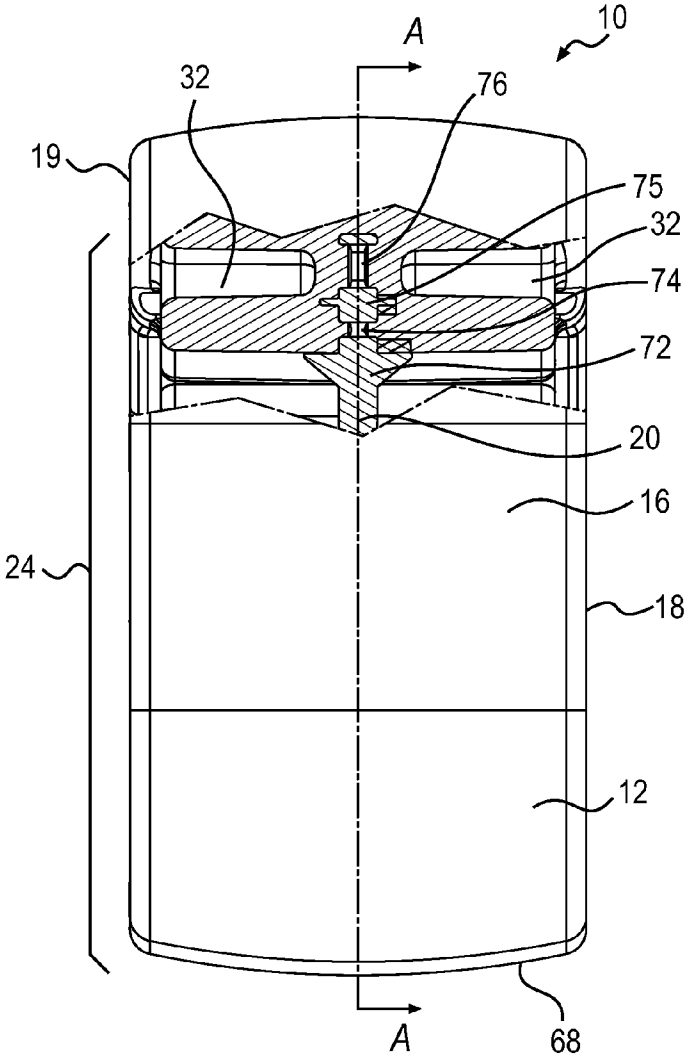
FIG. 4 is a right side elevation view of the fender FIG. 2 with a portion removed to show a partial cross-section.
Figure 5:
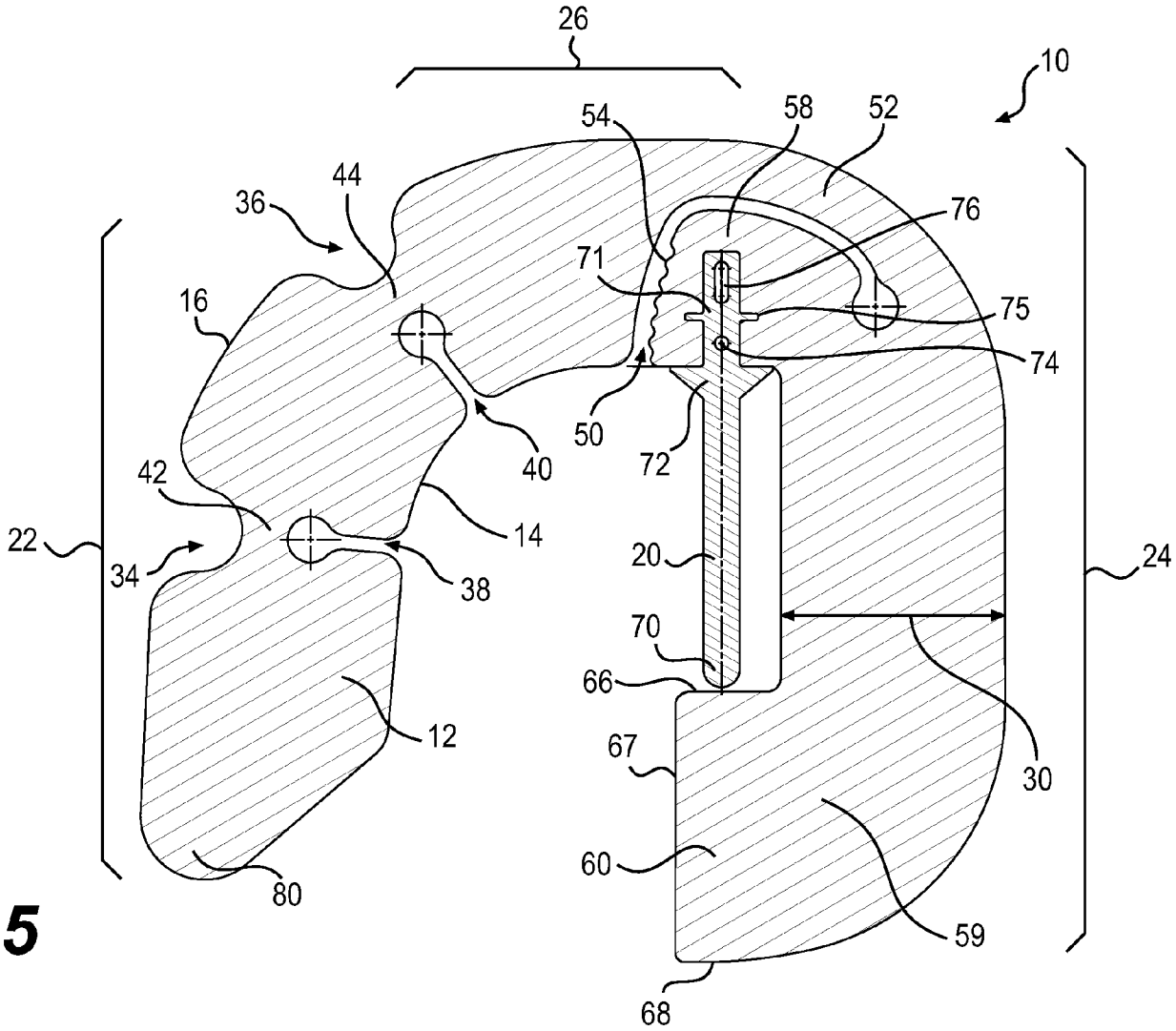
FIG. 5 is a cross-sectional view of the fender of FIG. 4 taken along line A-A in FIG. 4.

With reference to FIGS. 4 and 5, the pin 20 extends out of the fender body 12 from the end portion 58 between the channel 50 and the inner surface 14. An upper end 71 of the pin 20 is embedded in the end portion 58. Outside the fender body 12, the pin 20 extends generally parallel to the inner surface 14 of the outer portion 24 adjacent to the living hinge 52 when the fender 10 is unflexed. The free end 70 of the pin 20 is spaced from the projection 60. The pin 20 is centered between front and rear surfaces 18, 19.

With reference to FIG. 5, the portion 72 of the pin 20, adjacent to the fender body 12, is larger in diameter than diameter of the pin 20 below portion 72. The portion 72 of the pin 20 is also chamfered to facilitate its placement in a corresponding hole 195 (shown in FIG. 9). The upper end 71 of the pin 20 comprises two channels 74, 76 extending perpendicular to the front and rear surfaces 18, 19. A flange 75 extends radially outwards from the pin 20 between the channels 74, 76. The flange 75 and the portion 72 hold a portion of the fender body 12 therebetween, thereby helping to retain the pin 20 to the fender body 12.

The fender body 12 is formed of a closed-cell foam, by molding. It is contemplated that the fender body 12 could also be formed of an open-cell foam. The pin 20 is embedded in the fender body 12 by overmolding. The pin 20 is molded separately, and then its upper end 71 is inserted into the mold for the fender body 12 as the fender body 12 is being formed. The channels 74, 76 serve to anchor the pin 20 within the fender body 12. It is contemplated that the fender body 12 could be made of an inflated PVC bladder, or of any other suitable flexible, resilient and buoyant material by any other suitable methods. It is also contemplated that other methods of integrating the pin 20 into the fender body 12 could be used.

With reference to FIGS. 1A, 1B and 6 to 9, installation of the fender 10 on the bumper 110 at the deck/hull joint of the PWC 100 will now be discussed.

With reference to FIGS. 1A and 1B, the bumper 110 extends generally horizontally outwards from the generally vertical surfaces of the deck 106 and hull 104. The deck 106 extends upwards from the bumper 110 to the top of the gunnel 156. The height of the gunnel 156 above the bumper 110 is not uniform. A forward section 154, where one of the fenders 10 is installed (FIG. 1A), has a greater height than a rearward section 155, where the other fender 10 is installed (FIG. 1A).

The top of the rearward gunnel 155 is gently curved while the top of the forward gunnel 154 is more steeply curved. It is contemplated that the bumper 110 could also be curved.

Figure 6:
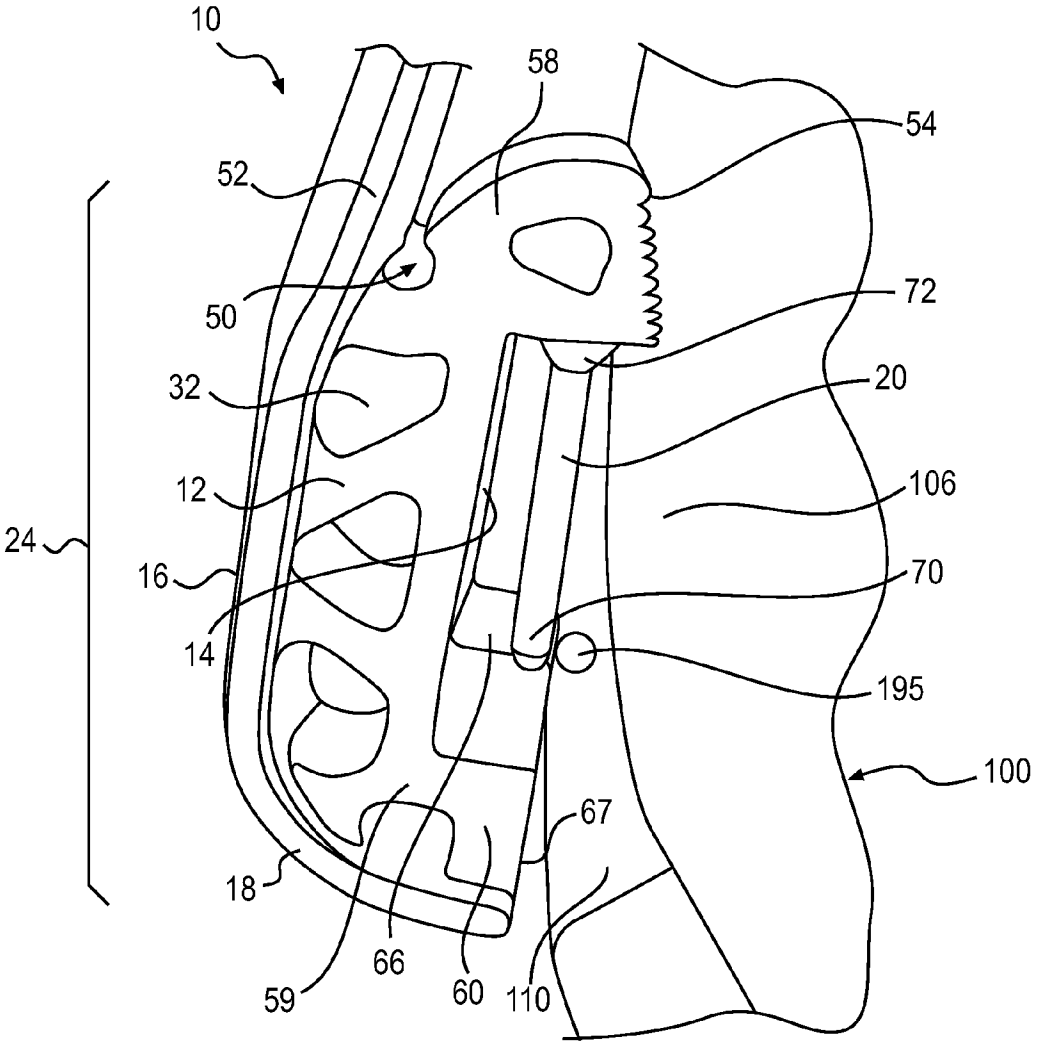
FIG. 6 is a perspective view, taken from a front, right side, of the fender of FIG. 2 as the fender is being installed on the forward portion of the PWC of FIG. 1A.

With reference to FIG. 6, the bumper 110 has a hole 195 for receiving the pin 20. The diameter of the hole 195 is at least as large as the diameter of the pin 20. The hole 195 extends generally vertically from the horizontal upper surface of the bumper 110 toward its generally horizontal lower surface. It is contemplated that the hole 195 could also be a through-hole.

The vertical hole 195 is parallel to the vertical outer surface of the bumper 110 and perpendicular to its horizontal upper and lower surfaces. It is contemplated that the hole 195 could extend at an angle to the horizontal upper and lower surfaces of the bumper 110. It is also contemplated that the hole 195 could extend at an angle with respect to the outer vertical surface of the bumper 110. For example, the hole 195 could be inclined inwards away from the vertical outer surface of the bumper 110.

Figure 7:
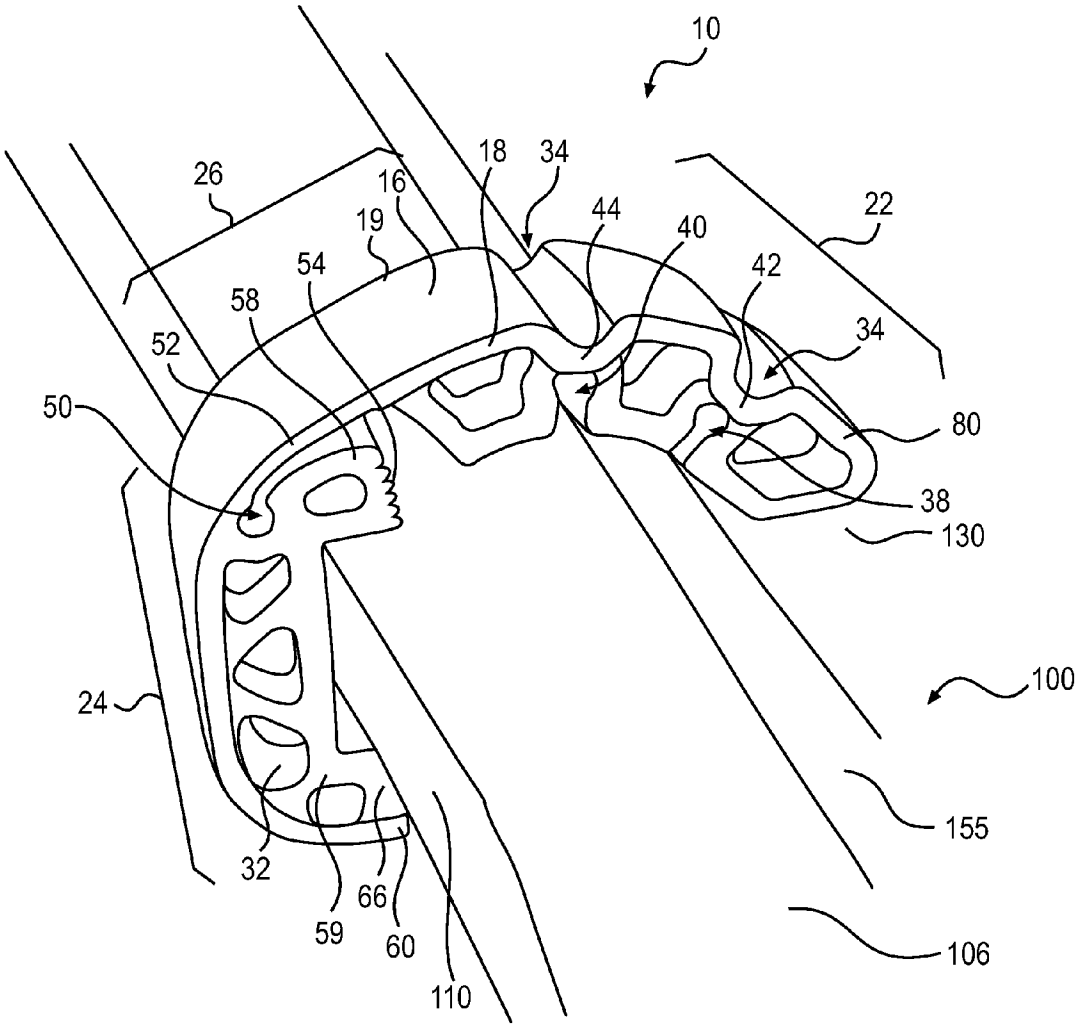
FIG. 7 is a perspective view, taken from the front, of the fender of FIG. 2 installed on the rearward portion of the PWC of FIG. 1A.
Figure 8:
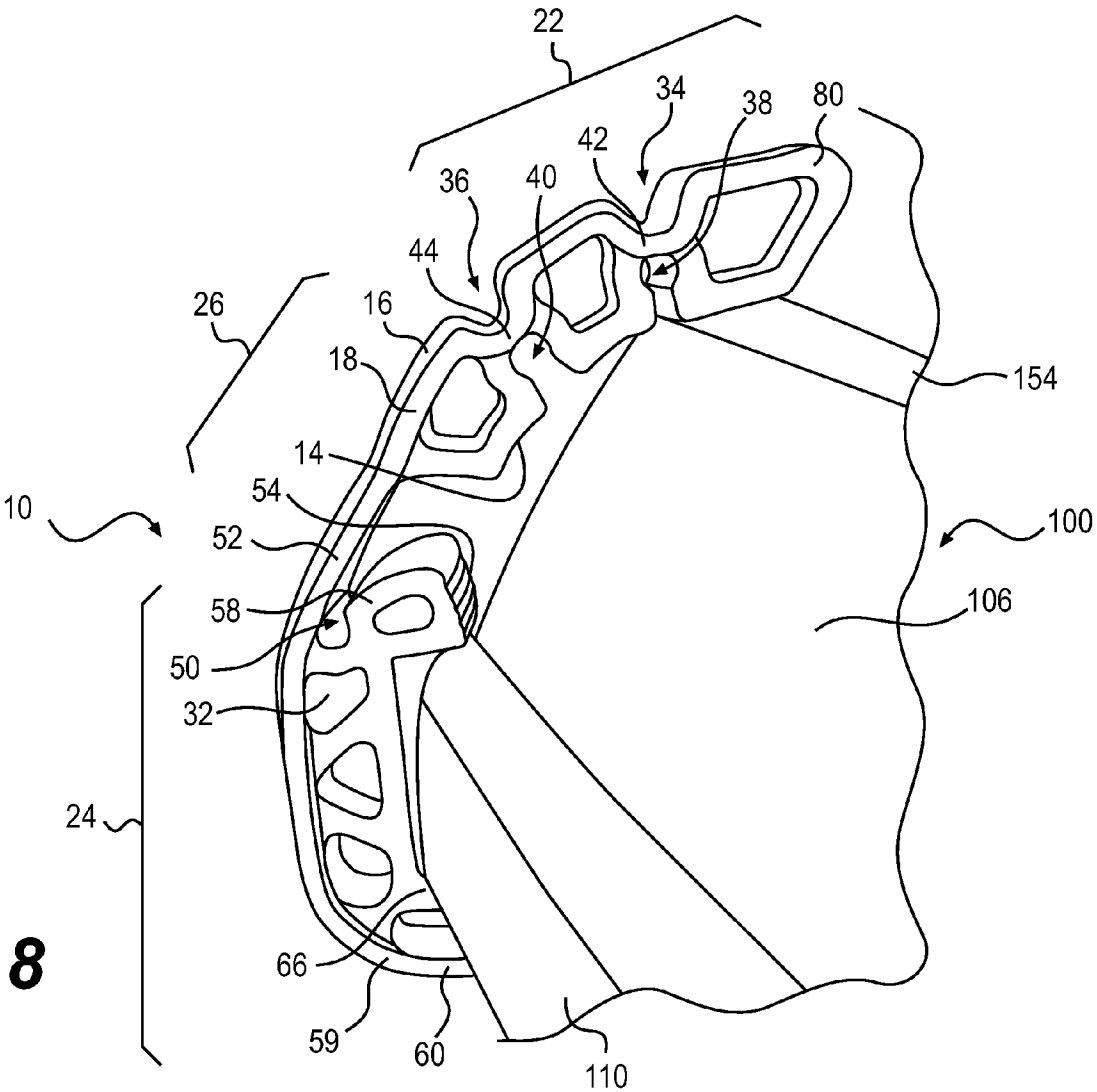
FIG. 8 is a perspective view, taken from the front, of the fender of FIG. 2 installed in the forward portion of the PWC of FIG. 1A.

FIG. 7 shows a fender 10 attached to a rearward gunnel 155 of the PWC 100. FIG. 8 shows a fender 10 attached to a forward gunnel 154 of the PWC 100. FIG. 9 shows the fender 10 attached to an outwardly extending flange 110' of a vertical wall 111'.

With reference to FIG. 6, the fender 10 is installed on the PWC 100 by first placing it along the vertical surface of the gunnel 156 above the bumper 110. The pin 20 is aligned with the hole 195. Although not shown in FIG. 6, the inner portion is placed over the gunnel 156 as can be seen in FIGS. 7 and 8. The channel wall 54 on the pin side of the channel 50 is textured (as can best seen in FIGS. 2, 3, and 5).

To install the fender 10 into a corresponding hole 195, it can be pushed downwards along the gunnel 156 while simultaneously pressing the textured channel wall 54 against the gunnel 156 to flex the fender 10. The textured wall 54 helps to grip the surface of the gunnel 156. As the textured wall 54 is pushed against the gunnel 156, the inner and central portions 22, 24 are pushed further away from the end portion 58 of the outer portion 24. The pin 20, which is embedded proximate the textured wall 54, swings inwards towards the gunnel 156, away from the projection 60 of the outer portion 24, thereby enabling insertion of the pin 20 into the hole 195. The pin 20 is pushed into the hole 195 until the projection 60 of the fender 10 extends underneath the bumper 110 thus securing the fender 10 to the PWC 100. As the pin 20 is being inserted into the hole 195, the resilient outer portion 24 can also be manually bent outwards to enable the projection 60 to go around the bumper 110.

With reference to FIGS. 7, 8 and 9, the surface 66 underneath the pin 20 engages the lower surface of the bumper 110 when the pin is inserted into the hole 195 of the bumper 110. If the hole 195 is a through-hole and the pin 20 is sufficiently long, the pin 20 would extend out of the opposite lower surface of the bumper 110. The lower surface of the bumper 110 would not be engaged by the surface 66 of the fender body 12 unless the fender 10 is lifted, thereby preventing undesired removal of the fender 10 from the PWC 100. In addition, the outer portion 24 can be spaced from the pin 20 so that at least a part of the inner surface 14 that extends opposite the pin 20 frictionally engages the outer surface of the bumper 110 when the pin 20 is positioned in the hole 195, thereby providing a further retaining force to keep the fender 10 in position. It is also contemplated that the hole 195 could be dimensioned so as to provide a friction-fit with the pin 20 to enable retention of the pin 20 in the hole 195.

As seen in FIG. 7, when the fender 10 is installed on the rearward gunnel 155, the inner portion 22 extends over the top of the gunnel 155 to the inside of the PWC 100. The end 80 of the inner portion 22 is suspended over the footrest 130 inside the PWC 100. The outer 24 and central portions 26 of the fender 10 are disposed outside of the PWC 100.

As can be seen in FIG. 8, when the fender 10 is installed on the forward gunnel 154, which extends further upwards from the bumper 110 than the rearward gunnel 156, the inner portion 22 extends over the top of the forward gunnel 154 with the end 80 of the inner portion 22 remaining suspended above the forward gunnel 154. The outer and central portions 24, 26 of the fender 10 are disposed outside of the PWC 100. The inner portion 22 is pivoted further away from the outer portion 24 in the fender 10 installed in the forward portion 192 than in the fender 10 installed in the rearward portion 190.

FIG. 9 shows the fender 10 installed on an outwardly extending flange 110' formed at the top of a vertical wall 111'. The flange 110' could be a bumper and the vertical wall 111' could be a part of the hull of a PWC, however, it could also be any other outwardly extending flange and vertical wall. A hole 195' extends through the flange 110'. The flange 110' and the fender 10 are sized and shaped such that the fender is unflexed when installed on the wall 111' and flange 110'. The inner surface 14 of the fender 10 is in contact with the upper surface of the wall 111' and the flange 110' but the projection 60 does not engage the lower surface of the flange 110' when the pin 20 is fully inserted in the hole 195'. The central portion 26 of the fender 10 is supported on the upper surface of the flange 110' while the inner and outer portions 22, 24 are disposed on opposite sides of the wall 111'.

With reference to FIGS. 7,8 and 9, the fender 10 is secured to the PWC 100 by the pin 20 inserted in the hole 195 whether the fender 10 is extended over the higher forward gunnel 154, the lower rearward gunnel 155 or a wall 111' extending below the flange 110' having the hole 195'. The fender 10 is retained on the PWC 100 as a result of the U-shaped fender body 12 and the pin 20. The U-shape of the fender body 12 enables the fender 10 to extend over the top of the gunnel 154, 155, 156 or the wall 111' so as to be supported by the gunnel 154, 155, 156 or the wall 111'. The pin 20 secures the fender 10 to the bumper 110 or flange 110' and enables the fender body 12 to be supported by the bumper 110 or the flange 110'.

The angled surfaces 62, 64 of the projection 60 underneath the pin 20 facilitate the use of the fender 10 with bumpers 110 that are angled or curved rather than being horizontal as in the PWC illustrated in FIG. 1A. In some PWCs, the bumper, or a section of the bumper, is at an angle with respect to the horizontal. In such an angled or curved bumper, the hole for receiving the pin could be formed so as to be perpendicular to the angled bumper or to be vertical (i.e. not perpendicular to the angled bumper). When an angled bumper has a vertical hole, a fender 10 having angled surfaces 62, 64 is better able to engage the angled bumper than a fender in which the surfaces 62, 64 are perpendicular to the pin 20. For aesthetic reasons as well, it may be more desirable for the fender 10 to be installed vertically upright (as shown in FIG. 1A) whether the bumper 110 is angled or horizontal. It is contemplated that the angled surfaces 62, 64 of the fender 10 could be omitted, however, the fit between the fender 10 and the angled or curved bumper 110 would not be as good as when the angled surfaces 62, 64 are present.

Flexing of the fender body 12 allows it to adapt to shapes and contours of the PWC surfaces. The living hinge 52, and to a lesser extend the regions 42, 44 of reduced thickness, facilitate the insertion of the pin 20 into a hole (not shown) formed at an angle to the vertical direction, for example, a hole extending inwards or outwards.

The fender 10 is not limited to being installed over the gunnel 156 and fastened to the bumper 110. The fender 10 could also be attached to any other flange or edge (for example, the flange 110' of FIG. 9) extending outwardly from a surface of the PWC 100 and permitting creation of a hole 195 for installation of the fender pin 20. It is contemplated that the above-described installation of the fender 10 on the PWC 100 can be achieved with only one hand.

It is contemplated that the PWC 100 could be manufactured with the appropriate holes 195 along the bumper 110 for receiving the pin 20 of the fender 10. However, the fender 10 can also be used with a PWC 100 that is not provided with prefabricated holes 195 adapted for receiving the pin 20 by using a sleeve 90 (FIG. 10) as described below.

Figure 10:
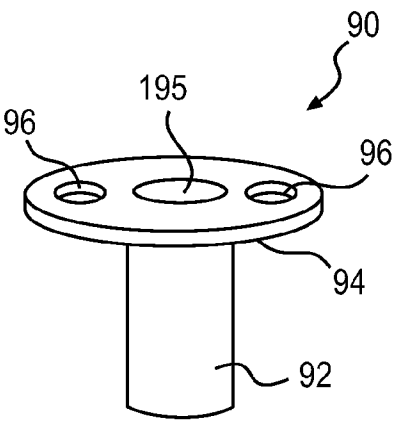
FIG. 10 is a perspective view, taken from a top, front, of a sleeve used for retaining the pin of the fender of FIG. 2 in accordance with another embodiment of the present invention.

With reference to FIG. 10, the sleeve 90 has a tubular portion 92 and a flange portion 94. The inner diameter of the tubular portion 92, having a diameter at least as large as the diameter of the pin 20, serves as the pin-receiving hole 195. The flange portion 94 is used to attach the sleeve 90 to the bumper 110. The flange 94 optionally has holes 96 on either side of the pin-receiving hole 195 of the tubular portion 92 to receive fasteners for fastening sleeve 90 to the bumper 110.

A PWC 100 can be adapted for use of the fender 10 by first drilling a vertical hole into the bumper 110. The diameter of the drilled hole is larger than the outer diameter of the tubular portion of the sleeve 92. The tubular portion 92 of the sleeve 90 is then inserted into the drilled hole. The sleeve 90 is fixed to the bumper 110 by inserting screws through the flange 94 (in holes 96 if provided) into the bumper 110. It is also contemplated that the sleeve 90 could be used to hold the pin upright in a hole 195, 195' formed in a hollow flange 110' or bumper 110. It is contemplated that other sleeves or inserts could similarly be used to adapt a PWC that was not manufactured with appropriate holes 195.

Figure 11:
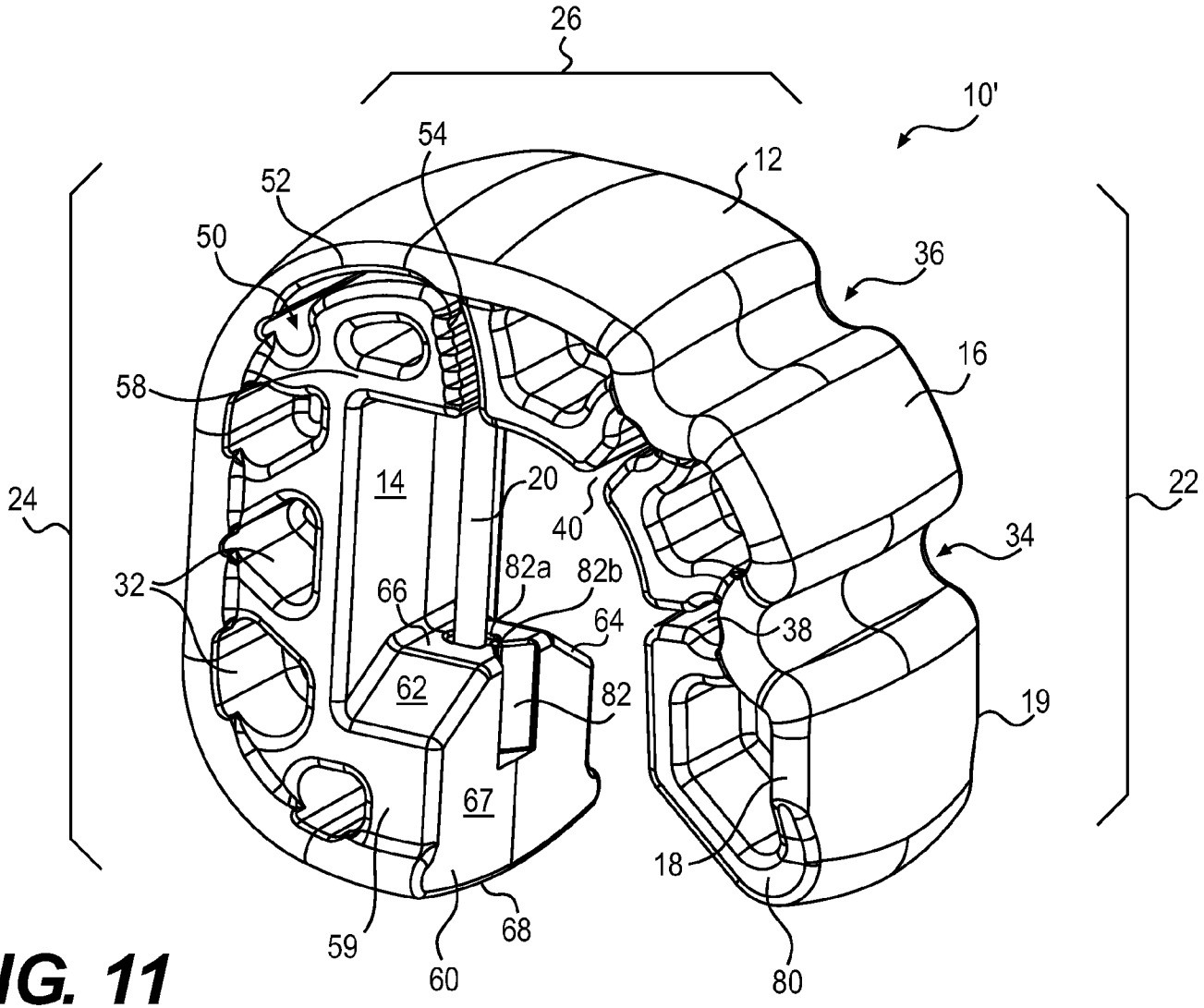
FIG. 11 is a perspective view, taken from a front, left side of another embodiment of a fender shown in isolation.
Figure 12:
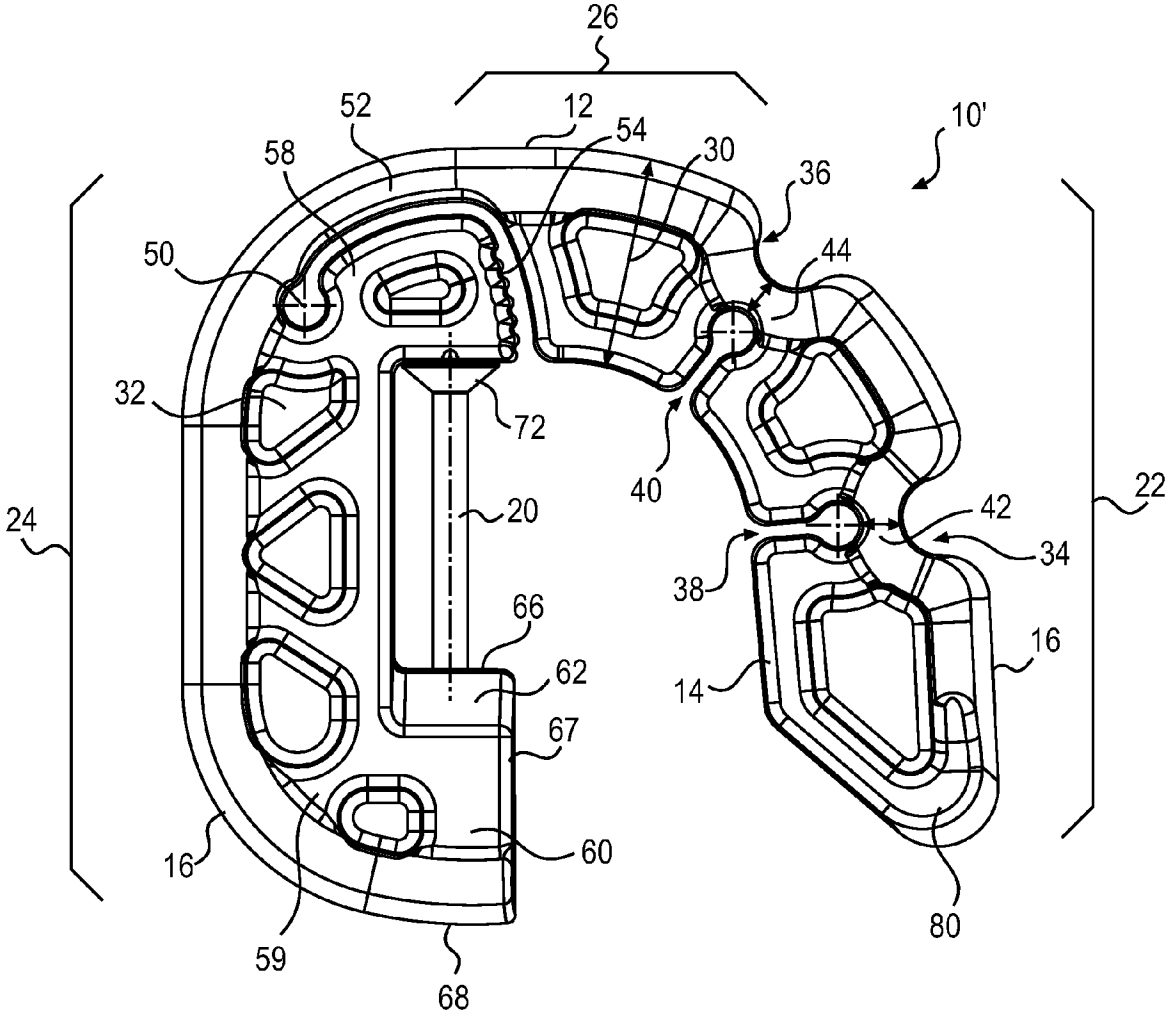
FIG. 12 is a front elevation view of the fender of FIG. 11.
Figure 13:
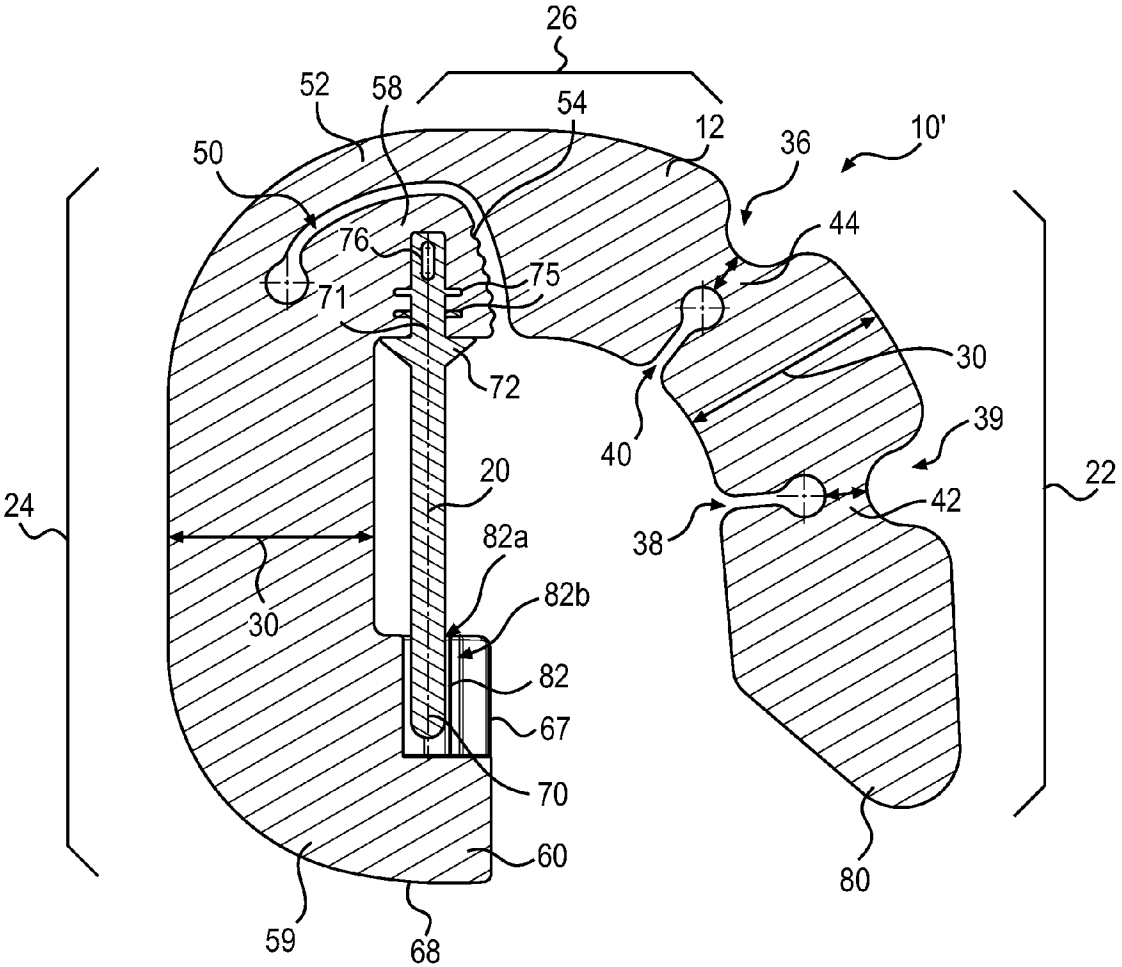
FIG. 13 is a cross-sectional view, similar to that of FIG. 5 but viewed in the opposite direction, of the fender of FIG. 11.

With reference to FIGS. 11 to 13, another embodiment of a fender 10' will now be described. The fender 10' has features similar to the features of the fender 10 shown in FIGS. 2 to 5. These features will be referred to using the same reference numerals, and will not be described below in detail.

With reference to FIG. 13, the upper end 71 of the pin 20 is embedded inside the end portion 58 between channel 50 and inner surface 14. The upper end 71 of the pin 20 comprises a single channel 76 extending perpendicular to the front and rear surfaces 18, 19 for anchoring the pin 20 within the fender body 12 during the molding process. The channel 74 of fender 10 (FIG. 5) has been omitted in fender 10' but it is contemplated that the fender 10' could include the channel 74 formed therein. Two flanges 75 extend radially outwards from the pin 20 below the channel 76 and above the chamfered portion 72 to retain the pin 20 to the fender body 12. In the unflexed configuration of the fender 10', the lower end 70 of the pin 20 is received in a slot 82 of the projection 60.

The slot 82 thus extends parallel to the pin 20 when the fender 10' is unflexed. The vertical slot 82 extends into the projection 60 from the centered region 66. The slot 82 extends from the inner surface 67 of the projection 60 facing the inner portion 22 of the fender body 12. In the illustrated embodiment of the fender 10', the slot 82 does not extend to the lower surface 68 of the projection 60. It is contemplated however that the slot 82 could extend through the projection 60 to the lower surface 68 opposite the centered region 66. The lower end 70 of the pin 20 is disposed in the slot 82 below the upper surface 66 and above the lower surface 68 of the projection 60. It is also contemplated that the lower end 70 could be disposed outside the slot 82 below the lower surface 68 of the projection 60.

The slot 82 is shaped to retain the lower portion of the pin 20, and to prevent the pin 20 from easily or inadvertently sliding out of the slot 82 in the direction perpendicular to the pin 20 from the opening in the inner surface 67. The slot 82 has a circular portion 82*a* which is aligned with the pin 20 in the unflexed configuration of the fender 10'. The circular portion 82*a* is circular in cross-section and sized to accommodate the pin 20 which has a circular cross-section. The slot 82 has a tapering portion 82*b* between the circular portion 82*a* and the inner surface 67. The tapering portion 82*b* is widest where it intersects the inner surface 67 and narrowest where it intersects the circular portion 82*a*. It is contemplated that the slot portion 82*a* aligned with the pin 20 could be shaped differently than the pin 20, or that the portion 82*a* and the pin 20 could both have cross-sectional shapes other than circular.

For installation of the fender 10' on the bumper 110, the pin 20 is placed into the hole 195 and the fender body 12 is pushed downwards until the projection 60 extends underneath the bumper 110 as for the installation of the fender 10. In addition, after the pin 20 has been pushed through the hole 195, the outer portion 24 having the projection 60 is pushed inwards towards inner portion 22 so as to push the lower end of the pin 20 into the slot 82. Since the fender 10' is made of resilient foam material, the tapering portion 82*b* widens when the pin 20 is pushed against it, allowing the pin 20 to pass through the tapering portion 82*b* into the circular portion 82*a* of slot 82. Once the pin 20 is in the circular portion 82*a*, the tapering portion 82*b* prevents the pin 20 from inadvertently sliding out therefrom, thereby retaining the fender 10' on the bumper 110.

The fender 10' can be removed from the bumper 110 by grasping the fender body 12 by the outer portion 24, and pulling the outer portion 24 away from the inner portion 22 so as to disengage the pin 20 from the slot 82. Once the pin 20 slides out of the slot 82, the fender body 12 can be pulled upwards to slide the pin 20 out of the hole 195 to disengage the fender 10' from the bumper 110.

It is contemplated that the slot 82 could not extend to the inner surface 67 of the projection 60. The lower end 70 of the pin 20 could instead be inserted into the slot 82 through the opening on the upper surface 66 by flexing the outer portion 24 of the fender body so as to place the lower end 70 of the pin 20 in the slot 82.

It is contemplated that, instead of extending to the inner surface 67, the slot 82 could extend to a front surface (such as the surface 18 or a surface parallel thereto) of the projection 60 and the pin 20 could be received in the slot 82 by pushing the projection 60 forward towards the pin 20. Similarly, the slot 82 could extend to a rear surface (such as the surface 19 or a surface parallel thereto) of the projection 60 and the pin 20 could be received in the slot 82 by pushing the projection 60 rearward towards the pin 20.

In the illustrated embodiments, the pin 20 of the fender 10' is longer than the pin 20 of the fender 10. It is also contemplated that instead of a longer pin 20, depending on the dimensions of the flange 110, the projection 60 of the fender 10' could be disposed higher on the outer portion 24 of the fender body 12 than as shown so as to receive the lower portion of the pin 20 in the slot 82.

Figure 14B:
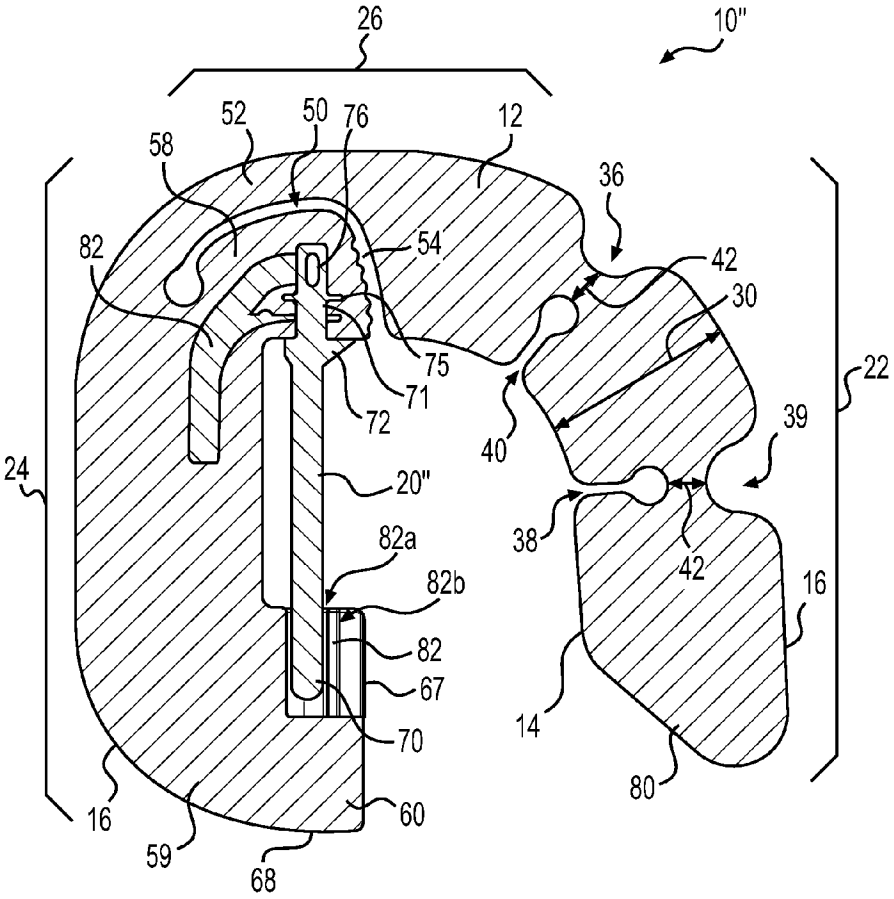
FIG. 14B is a cross-sectional view, similar to that of FIG. 13, of a fender having the pin of FIG. 14A.
Figure 14A:
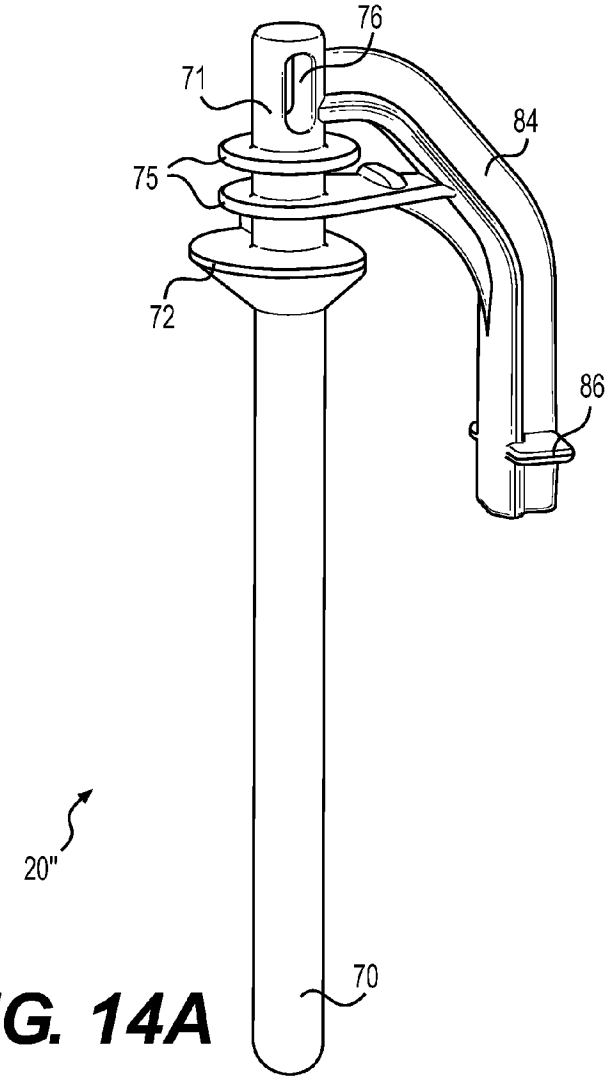
FIG. 14A is a perspective view taken from a rear, right side of a fender pin according to yet another embodiment.

With reference to FIGS. 14A and 14B, yet another embodiment of a fender 10" having a pin 20" is shown. The fender 10" has features similar to the features of the fender fender 10 of FIGS. 2 to 10 and the fender 10" shown in the FIGS. 11 to 13. These features will be referred to using the same reference numerals, and will not be described below in detail.

The pin 20" has an anchor portion 84 that extends outwards and downwards from the upper end 71. The anchor portion 84 is embedded in the outer portion 24 of the fender body 12. The anchor portion 84 serves to strengthen the connection of the pin 20" with the fender body 12. The anchor portion 84 also aids in securing the fender 10" to the bumper 110 by providing rigidity against the flexing of the outer portion 24 with respect to the pin 20". The lower portion of the anchor portion 84 extends parallel to the pin 20" but it is contemplated that it could be disposed at an angle to the pin 20". The lower anchor portion 84 has a T-shaped cross-section with a transverse flange 86 (FIG. 14A) near its distal end. It is contemplated that the anchor portion 84 could extend lower or higher in the fender body 12 than as shown herein. It is contemplated that the transverse flange 86 could have a different shape and size than as shown, or that it could be omitted.

The upper end 71 of the pin 20" has a pair of radially extending flanges 75 and a channel 76 as in the fender 10' of FIGS. 11 to 13. The lower flange 75 connects to the anchor portion 84 such that a portion of the fender body 12 is held between the anchor portion 84 and the lower flange 75 which aids in retaining the pin 20" to the fender body 12. The portion 72 of the pin 20" adjacent to the fender body 12 has a larger diameter than the pin 20" extending therebelow. The portion 72 is partly chamfered on the edge facing the outer portion 24 while the edge facing the inner portion 22 is fully chamfered.

The projection 60 of the fender body 12 has a slot 82 and the lower end 70 of the pin 20" is received in the slot 82 as in the fender 10' of FIGS. 11 to 13. It is however contemplated that the slot 82 could be omitted, and the length of the pin 20" could be shorter such that the lower end 70 could be a free end extending outside the fender body 12 as in the fender 10 of FIGS. 2 to 10.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A fender for a watercraft having a flange extending outwardly therefrom and a hole extending at least partially through the flange, the fender comprising:
- a fender body comprising:
  - a first end;
  - a second end spaced from the first end;
  - at least one region of reduced thickness disposed between the first end and the second end, at least one of the at least one region of reduced thickness being defined at least in part by a living hinge;
  - an inner surface facing inwardly towards the flange when the fender is mounted thereto;
  - an outer surface facing outwardly from the flange when the fender is mounted thereto;
  - an inner portion;
  - an outer portion; and
  - a central portion connecting the inner portion to the outer portion, the central portion being connected to the outer portion along the outer surface by the living hinge,
- the fender body being generally U-shaped and being flexible at least in part due to the at least one region of reduced thickness, and
- the fender body extending at least partially around the flange when the fender is mounted to the flange; and
- a pin extending from the fender body, the pin being removably received in the hole for removably retaining the fender to the flange when the fender is mounted to the flange,
- the fender being thereby removably mountable to the flange.

2. The fender of claim 1, wherein the pin extends from one of the outer portion and the central portion of the fender body.

3. The fender of claim 1, wherein at least one of the at least one region of reduced thickness is defined at least in part by a groove, the inner surface of the inner portion having the groove extending into the fender body towards the outer surface.

4. The fender of claim 3, wherein the outer surface has an indentation opposite the groove of the inner surface.

5. The fender of claim 1, wherein:
- the living hinge is defined by a channel;
- the channel extends between the outer portion and the central portion;
- the channel extends from the inner surface into the fender body towards the outer surface.

6. The fender of claim 1, wherein one of the outer portion and the central portion comprises a gripping surface selectively engaging the watercraft, the gripping surface being proximate the pin.

7. The fender of claim 6, wherein the gripping surface extends from the inner surface towards the outer surface.

8. The fender of claim 1, wherein:
- the pin has a first end, held by one of the outer portion and the central portion of the fender body, and a second end opposite the first end; and
- the outer portion comprises a projection extending inwardly towards the inner portion.

9. The fender of claim 8, wherein the projection has a surface disposed substantially perpendicular to the pin and facing toward the first end of the pin.

10. The fender of claim 9, wherein the surface of the projection is a first surface, the projection having a second surface disposed at an obtuse angle to the pin, the second surface being adjacent to the first surface.

11. The fender of claim 9, further comprising a slot extending into the projection from the surface;
- wherein at least a portion of the pin is removably received in the slot.

12. The fender of claim 11, wherein:
- the projection has an inner surface disposed substantially parallel to the pin; and
- the slot extends from the inner surface such that the pin is received into the slot from the inner surface.

13. The fender of claim 1, wherein the fender body is formed of molded foam.

14. The fender of claim 13, wherein the pin is overmolded in the fender body.

15. A watercraft, comprising
- a hull;
- a deck disposed on the hull and connected thereto;
- a flange extending outwardly from at least one of the deck and the hull;
- an upper surface of the flange comprising a hole extending at least partly through the flange; and
- a fender being removably mounted to the flange, the fender comprising:
  - a fender body comprising:
    - a first end;
    - a second end spaced from the first end;
    - at least one region of reduced thickness disposed between the first end and the second end, at least one of the at least one region of reduced thickness being defined at least in part by a living hinge;
    - an inner surface facing inwardly towards the flange when the fender is mounted thereto;
    - an outer surface facing outwardly from the flange when the fender is mounted thereto;

an inner portion;

an outer portion; and a central portion connecting the inner portion to the outer portion, the central portion being connected to the outer portion along the outer surface by the living hinge, the fender body being generally U-shaped and being flexible at least in part due to the at least one region of reduced thickness, and the fender body extending at least partly around the flange when the fender is mounted to the flange; and a pin extending from the fender body, the pin being removably received in the hole when the fender is mounted to the flange.

16. A method for installing a fender on a watercraft, the watercraft having a flange extending outwardly therefrom and a hole extending at least partly through the flange, the fender having a fender body and a pin extending from the fender body, the fender body comprising a first end, a second end spaced therefrom and at least one region of reduced thickness disposed between the first end and the second end, the fender body being flexible at least in part due to the at least one region of reduced thickness, the method comprising:

placing the fender above the flange;

aligning the pin with the hole;

moving the fender towards the flange;

inserting the pin into the hole by moving the fender towards the flange;

extending the fender body at least partly around the flange by flexing a portion of the fender body having the at least one region of reduced thickness;

after extending the fender body at least partly around the flange, pushing an inwardly extending projection of the fender body towards the pin; and receiving the pin in a slot defined in the projection.

17. The method of claim 16, further comprising, before inserting the pin into the hole, pressing the fender body against a surface of the watercraft above the flange to flex at least a portion of the fender body.

18. The method of claim 16, further comprising extending a portion of the fender body over an upwardly facing edge, the upwardly facing edge being disposed above the outwardly extending flange.

* * * * *